US009624626B1

(12) United States Patent
Schaeding

(10) Patent No.: US 9,624,626 B1
(45) Date of Patent: Apr. 18, 2017

(54) GEOMETRICALLY CONSTRAINED SLOPE CONTROL SYSTEM FOR CYLINDER CONSTRUCTION EQUIPMENT

(71) Applicant: GOMACO Corporation, Ida Grove, IA (US)

(72) Inventor: Chad Schaeding, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 20 days.

(21) Appl. No.: 14/515,222

(22) Filed: Oct. 15, 2014

Related U.S. Application Data

(60) Provisional application No. 61/891,131, filed on Oct. 15, 2013.

(51) Int. Cl.
*E01C 19/00* (2006.01)

(52) U.S. Cl.
CPC ..... *E01C 19/00* (2013.01); *E01C 2301/00* (2013.01)

(58) Field of Classification Search
None
See application file for complete search history.

(56) References Cited

U.S. PATENT DOCUMENTS

| | | | | |
|---|---|---|---|---|
| 4,266,917 | A * | 5/1981 | Godbersen | E01C 19/4893 249/8 |
| 7,077,601 | B2 * | 7/2006 | Lloyd | E01C 23/065 180/209 |
| 7,850,395 | B1 * | 12/2010 | Brenner | E01C 23/01 404/72 |
| 2011/0236129 | A1 * | 9/2011 | Guntert, Jr. | E01C 19/42 404/72 |
| 2013/0190991 | A1 * | 7/2013 | Fritz | E01C 19/004 701/50 |

* cited by examiner

*Primary Examiner* — John R Olszeski
*Assistant Examiner* — James M McPherson
(74) *Attorney, Agent, or Firm* — Suiter Swantz pc llo

(57) ABSTRACT

A computer control system in a paving machine determines a location, long slope (pitch), cross-slope (roll), and elevation (with respect to reference surface) of the machine with reference to a plurality of sensors. The long slope, cross slope and elevation are compared to values from a design surface (horizontal alignment, vertical profile, and cross sections) using the location of the machine to query the design data. Deviations from measured orientation and elevation to the design (desired values) are determined for each elevation cylinder of the paving machine based on the sensor data using constrained geometric control algorithms that predict future deviations. Corrections are applied to bring the actual location, long slope, cross-slope and elevation to within acceptable tolerances of the desired values. Sensors are associated with specific legs, with some sensors associated with more than one leg, such that sensor values may be averaged to reduce error.

20 Claims, 10 Drawing Sheets

GEOMETRICALLY CONSTRAINED SLOPE CONTROL SYSTEM FOR CYLINDER CONSTRUCTION EQUIPMENT

PRIORITY

The present application claims the benefit under 35 U.S.C. §119(e) of U.S. Provisional Application Ser. No. 61/891,131, filed Oct. 15, 2013, which is incorporated herein by reference.

FIELD OF THE INVENTION

The present invention is directed generally toward paving machines and more particularly toward systems for controlling the slope of a paving machine.

BACKGROUND OF THE INVENTION

Paving machines, and construction machines in general, require substantial in movement and orientation to produce the desired outcome. Especially in regards to paving machines, long slope and cross-slope of the machine must be controlled within very tight tolerances. However, paving machines are large and often operate in hostile environments. Constantly monitoring and adjusting the orientation of a paving machine for the proper long slope and cross-slope is a laborious process.

Systems exist to control the linear movement of paving machines with a high degree of precision, however those systems often only provide a single reference point which is insufficient for locating the machine in three dimensions. Alternatively, surveying equipment may adequately define the location and orientation of a machine in space, but such systems are very expensive (in initial capital investment but more so in high skilled labor cost to operate on a daily basis).

Consequently, it would be advantageous if an apparatus existed that is suitable for controlling construction equipment in multiple dimensions with reference to the surface being modified.

SUMMARY OF THE INVENTION

Accordingly, the present invention is directed to a novel method and apparatus for controlling construction equipment in multiple dimensions with reference to the surface being modified.

In one embodiment, a computer control system in a paving machine determines a location, long slope (pitch), cross-slope (roll), and elevation (with respect to reference surface) of the machine with reference to a plurality of sensors. The long slope, cross slope and elevation are compared to values from a design surface (horizontal alignment, vertical profile, and cross sections) using the location of the machine to query the design data. Deviations from measured orientation and elevation to the design (desired values) are determined for each elevation cylinder of the paving machine based on the sensor data using constrained geometric control algorithms. Corrections are applied to bring the actual location, long slope, cross-slope and elevation to within acceptable tolerances of the desired values.

In another embodiment, constrained geometric control algorithms predict future deviations and apply there corrections immediately rather than waiting for a change in the sensor data. The result of a constrained method is a more responsive control system which permits accurate slope control even with poor (undulating) trackline.

In another embodiment, sensors are associated with specific legs such that sensor values may be averaged to reduce error. Furthermore, sensor may be associated with more than one leg such that more values may be used to determine the average without adding additional sensors.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
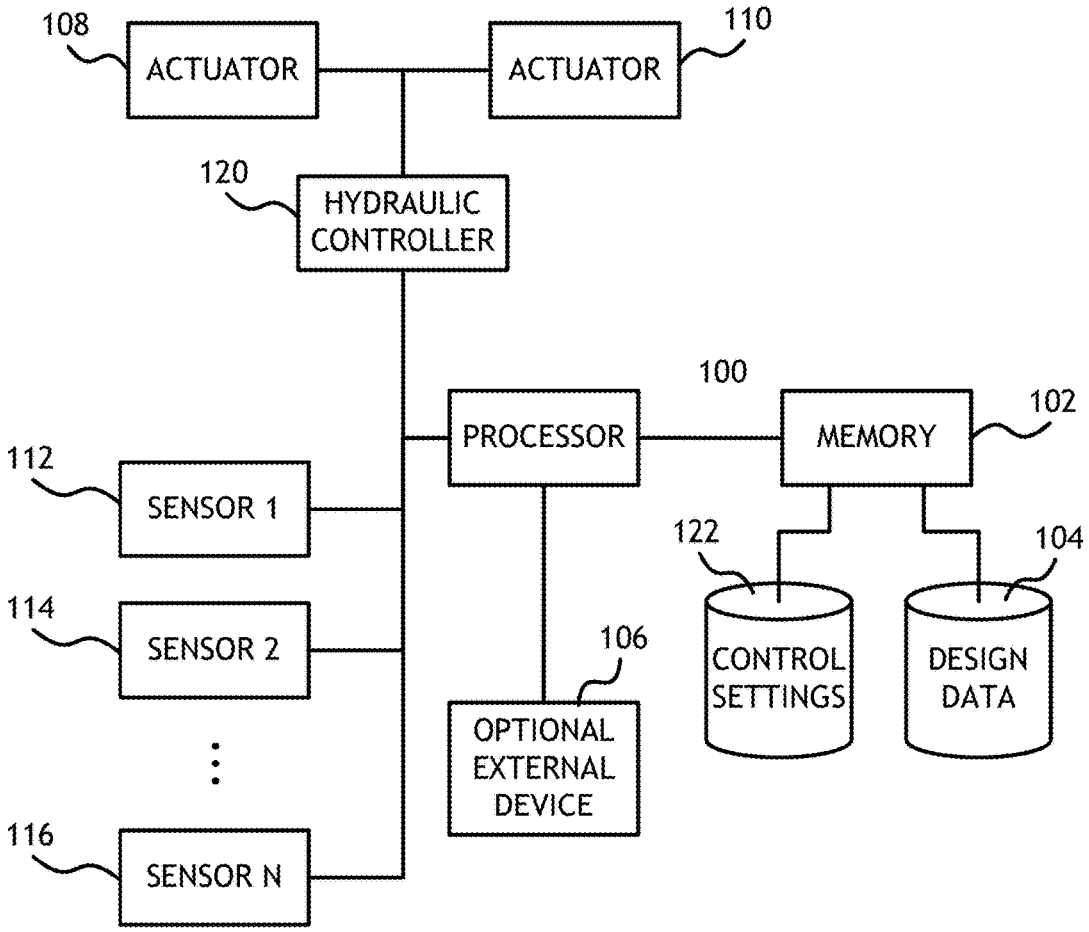
FIG. 1 shows a block diagram of a computer system useful for implementing embodiments of the present invention.

Referring to FIG. 1, a block diagram of a computer system useful for implementing embodiments of the present invention is shown. The computer system, embodied in a paving machine, may include a processor 100 configured to execute computer executable program code stored in a memory 102 connected to the processor 100. A desired paving profile, or some other data defining the desired movement and orientation of the construction machine, may be stored in a data storage element 104 also connected to the processor 100, potentially through the memory 102, or accessible to the processor 100 via a remote data connection such as through an external design data device 106. The external design data device 106 may comprise a GPS or other 3D positioning system with its own sub-system of sensors, interface, and memory to store initial settings, machine dimensions, and the design data. The external design data device 106 may broadcast or stream the desired long slope and cross-slope values to the processor 100.

The processor 100 may receive position and slope information through a plurality of sensors 112, 114, 116. The sensors 112, 114, 116 may be positioned at various, known locations on the paving machine to provide information to the processor 100 regarding the multi-dimensional orientation of the paving machine. At a minimum, pavers require two dual axis slope sensors 112, 114, 116 mounted near the end-cars to measure flexing (torsion) of the machine. A paver including a system according to the present invention does not require an additional center cross-slope sensor 112, 114, 116, 116 because, by using dual axis sensors 112, 114, 116 on the end-cars, a processor 100 can calculate what that sensor 112, 114, 116, 116 value would be, e.g. average each cross-slope value. Additional sensors 112, 114, 116 may be distributed along the frame above the extruding edge to further improve the average machine cross-slope accuracy.

Embodiments of the present invention may automatically control paving and other construction equipment in six dimensions, ensuring that the machine is at the correct position (Easting, Northing, and Height), orientation (Heading, Long, and Cross-slope), and that it smoothly travels through its designed path. This system relays six deviation corrections, two steering corrections and four grade corrections, to the two or more actuators 108, 110 (possibly through one or more hydraulic controllers) connected to the processor 100. Embodiments of the present invention return a construction machine to a desired position and orientation as defined by a design profile.

A design surface may include variable design values that are dependent on position. The position of a machine including embodiments of the present invention may be determined with reference to one or more surveying machines (total stations), GPS, track or wheel encoder, or other absolute or relative positioning system. Positioning information may be determined by the processor 100 based on available data or may be transmitted to the processor 100 via the data connection to the external design data device 106. The design surface defines set-points including slope values. The processor 100 manipulates the one or more actuators 108, 110 based on values received from the sensors 112, 114, 116 to drive the machine to a variable set-point that may be dependent on position.

Existing design profile protocols may not provide sufficient data to completely control a machine with four elevation cylinders. The processor 100 may exchange design data on a common controller area network bus. The processor 100 may then use the variable set-point to fully automate a slope and grade controlled machine.

In one embodiment, deviation correction data is packaged into two controller area network messages (steer and grade) which are sent to a hydraulic controller 120 configured to control a plurality of the two or more actuators 108, 110 on a machine controller area network. Split networks allow the user to use any number of sensors 112, 114, 116 without adding traffic to the machine controller area network because sensor 112, 114, 116 messages are left on the sensor controller area network. Controller area network architecture is desirable for data communication due the harsh environment where paving and construction equipment operates, however any viable network data communication methodology may be used. Each slave controller has its own sensor controller area network to allow plug and play automatic recognition of controller area network sensors.

The processor 100 input may be any real or virtual sensor 112, 114, 116 measurements that will output a deviation from a design surface. A real sensor 112, 114, 116 directly measures and outputs a distance from a reference. Real sensors 112, 114, 116 may include sonic sensors, rotary sensors, skis, laser receivers, stringline sensors or any other such physical sensory apparatus. Sensors 112, 114, 116 may have a large dynamic range to allow for transitions to take place. In one example, a laser receiver with a total range of two feet may allow for a transition from the bottom to the top of the sensor's 112, 114, 116 range and still properly read the transmitted laser beam.

Virtual sensors 112, 114, 116 may include the output from a 3D system. The interruption, inspection, and forwarding of some or all of the 3D corrections, along with the use of other sensors 112, 114, 116, provides a user with substantial flexibility.

In one embodiment, the processor 100 averages values from the plurality of sensors 112, 114, 116 measuring a distance from known locations on the machine to a reference surface for controlling a finish grade. Steering may be controlled by reference to satellite based positioning system such as the Global Positioning System (GPS) for precise alignment. Combinations of sensor 112, 114, 116 data according to embodiments of the present invention may provide a desired concrete yield, smoothness, slope, and correct position of a finished surface.

In one embodiment of the present invention, the entire system, including processor 100 and sensors 112, 114, 116, may be placed on the machine, saving labor cost as compared to methodologies known in the art.

In one embodiment of the present invention, the processor 100 receives sensor 112, 114, 116 data and removes zeroed values. The resulting deviation from a set point is then scaled by a predetermine sensor 112, 114, 116 sensitivity. Each sensor 112, 114, 116 is assigned a weight and an output variable. Outputs may include four grade, two steer deviations, cross-slope, left and right long slope, stationing and other slope values as appropriate.

The processor 100 then combines the sensor 112, 114, 116 deviations to constrain the machines position and/or orientation with corrections. The processor 100 may also apply individual offsets, filters and sensitivity the outputs to maximize response while minimizing instability of the corrections.

Each sensor 112, 114, 116 may require a degree of calibration and zeroing. For each sensor 112, 114, 116 a center value is subtracted from an observed value. For slope, this would be the value observed when the machine frame is leveled. However for a virtual sensor (3D) it will be its null point.

Once the data is centered about zero, it is scaled to a consistent unit base, such as millimeters or 1/1000th foot. Sensor 112, 114, 116 deviation s for a particular sensor j may be defined by:

$$s_j=\alpha_j*(l_j-z_j)$$

where $\alpha$ is sensitivity; l is the measurement and z is the zero value.

Each output can have any number of sensors 112, 114, 116 assigned to it. Each sensor 112, 114, 116 weight will determine the influence of the sensor's 112, 114 contribution to the output deviation. A weighted average output deviation d for a particular instance o may be defined by:

$$d_o = \frac{1}{\sum_{i=1}^{n} (w_i)} * \sum_{i=1}^{n} (w_i s_i)$$

where w is the weight of a particular sensor i; s is sensor deviation; n is the total number of sensors for the output.

The output deviation may be sequentially updated, after sensors 112, 114, 116 with a corresponding output assignment are updated. After all the sensors 112, 114, 116 are checked, the weighted summation is normalized by the inverse of the sum off the weights, to return the average. At the beginning of the next loop the weighted summation and sum of the weights is reset to zero.

In at least one embodiment, sensor 112, 114, 116 deviation d for each output o is subtracted from a design profile value D to determine a correction c needed to return the output value to the desired, design value:

$$c_o = D_o - d_o$$

The design profile values can be a depth if the grade sensors 112, 114, 116 are zeroed when the machine is on the sub-grade. They can also be slope values such as a cross-slope of 2%. Design profile values can be grouped, in the case of an all jog, front only offset, rear only offset, left side offset, or right side offset.

The processor 100 may then perform a linear transformation to scale and shift the output to produce grade and steer deviation messages for a machine controller network. The scale value is the output deviation sensitivity, with a larger scale providing a faster drive to return the deviation to zero. An additional shift may be applied, to produce a 3D formatted data value G for output o:

$$G_o = b_o * c_o + t$$

where b is output sensitivity; c is the output correction; and t is an optional shift value.

In one exemplary embodiment, when a 3D message is required, null values may be defined as some absolute value. For all other implementations null should be zero and the correction may be a signed value (+/−) from zero.

Additional embodiments may be useful with various sensor 112, 114, 116 combinations for many applications.

In another embodiment of the present invention, the processor 100 is configured to calculate four elevation cylinder deviations and use such values to correct slope control. The processor 100 determines the grade deviation of a predetermined "controlling" leg (for exemplary purposes, the left rear leg LR is discussed) by $c_{LR} = D_{LR} - d_{LR}$ as discussed above. The grade deviation can come from any available sensor 112, 114, 116 or if no sensor 112, 114, 116 is present or it is unassigned as an output, the deviation may be considered zero and the leg is fixed.

All further geometric calculations are constrained to the controlling elevation cylinder such that any movement of the controlling leg will result in a corresponding movement of the same distances by all the other legs. Neighboring legs, in this case the right rear leg RR and left front leg LR, first add their deviations/corrections on top of the controlling leg:

$$c_{LF} = c_{LR} L * (D_1 - LS)$$

$$c_{RR} = c_{LR} W * (D_{CS} - CS)$$

where L is the length of the machine; W is the width of the machine; D is a design profile value for either inclination i or cross-slope CS; LS is the left long slope; and CS is the cross-slope at (along) the rear of the machine.

The remaining leg, in this case the right front RF, is further constrained because its grade is relative to the right rear leg RR, which is relative to the left rear leg LR:

$$c_{RF} = c_{LR} W * (D_{CS} - CS) + L * (D_1 - RS)$$

$$c_{RF} = c_{RR} L * (D_1 - RS)$$

were RS is the right long slope.

The $c_{LR}$ and $c_{RR}$ values (Elevation Error) are added to the slope component, e.g. slope deviation from the design value and multiplied by the length and width. Adding $c_{LR}$ and $c_{RR}$, for this grade mode, increase the responsiveness. All other slope control algorithms do not do this and therefore are less responsive and inferior.

Each sensor 112, 114, 116 may have an uncertainty associated with it. In some embodiments, slope sensors 112, 114, 116 may have a standard error of 0.05% (variance of 0.0025%) and fixing the left rear leg LR with a variance of 0, and assuming distances are without error (for example L is 15' and W is 30'), variance equations for the remaining legs are:

$$\sigma_{LF}^2 = \sigma_{LR}^2 + L^2 * \sigma_{LS}^2$$

$$\sigma_{LF}^2 = 0 + 15' * 15' * 0.0005 * 0.0005$$

$$\sigma_{LF} = 0.008'$$

$$\sigma_{RR}^2 = \sigma_{LR}^2 + W^2 * \sigma_{CS}^2$$

$$\sigma_{RR}^2 = 0 + 30' * 30' * 0.0005 * 0.0005$$

$$\sigma_{RR} = 0.015'$$

The right rear leg RR is controlled by the machine cross-slope, assuming a single sensor 112, 114, 116 so that the standard error is equal to the long slope standard error. Because the right front leg RF is controlled from the right rear leg RR, the right front leg RF would have all the error of the right rear leg RR plus the additional error contribution from the right long slope sensor 112, 114, 116.

$$\sigma_{RF}^2 = \sigma_{RR}^2 + L^2 * \sigma_{RS}^2$$

$$\sigma_{RF}^2 = 0.015^2 + 15' * 15' * 0.0005 * 0.0005$$

$$\sigma_{RF} = 0.017'$$

Such embodiment may be useful in both auto-level grade mode and variants where the design long slope and cross slope values ($D_1$=design long slope, $D_{CS}$=design cross slope) where these values can either be zero (auto-level), non-zero, or changing (slope transitions).

The leg opposite the fixed leg (here the right front leg RF) has the most uncertainty and will be noisier, requiring a smaller output sensitivity to stabilize. Response will be correspondingly weakened (slower and introduce a larger round-off dead-band). The largest contributing factor to the error in the right front leg RF is the cross-slope error acting on the right rear leg RR. Such cross-slope error can be minimized by reducing the variance of the cross-slope measurement or by reducing the machine width.

To further reduce cross-slope error, additional sensors 112, 114, 116 may be added. As the number N of sensors 112, 114, 116 increases, certainty in the mean value will increase resulting in a smaller standard error.

$$\sigma_m = \frac{\sigma_s}{\sqrt{N}}$$

By averaging four cross-slope sensors 112, 114, 116 standard error in the cross-slope may be halved. The right rear leg RR error propagation with four cross-slope sensors in this exemplary embodiment is:

$$\sigma_{RR}^2=0+30'*30'*0.00025*0.00025$$

$$\sigma_{RR}=0.008'$$

With the right rear leg RR error reduced, right front leg RF error is also reduced. Variances are added for linear equations, not standard deviations.

$$\sigma_{RF}^2=0.0075^2+15'*15'*0.0005*0.0005$$

$$\sigma_{RF}=0.011'$$

This technique of averaging uses statistical methodologies such as standard deviation of the mean to improve the accuracy of the system. With a load on the machine the actual standard deviation for a reasonable trackline is approximately 0.03%. Use four slope sensors 112, 114, 116 for the average, e.g. N=4, the standard deviation is cut in half. Using a system according to the present invention, the machine width may be doubled while maintaining the same accuracy for grade control on the slope side (<⅛" or 3 mm).

Error propagation is similar for all slope methods with appropriate substitutions for the machine size, number of sensors 112, 114, 116, and the variance estimates for the sensors 112, 114, 116.

In another embodiment of the present invention, the processor 100 matches the grade on either side of the machine, controls the cross-slope, and match the long slope side to the long slope on the grade side. The grade side can be controlled by locking the legs, using analog grade sensors 112, 114, 116, using controller area network based sensors 112, 114, 116 of any type, or from a 3D system.

$$c_{LR}=D_{LR}-d_{LR}$$

$$c_{LF}=D_{LF}-d_{LF}$$

The cross-slope is controlled similar to the self-leveling method. The measured long slope on the grade side is then substituted as the design long slope for the matching side.

$$c_{RR}=c_{LR}+W*(D_{CS}-CS)$$

$$c_{RF}=c_{RR}+L*(LS-RS)$$

Error propagation for the right rear leg RR is substantially similar. The right front leg RF correction may include the additional uncertainty of the error in the driving sensors 112, 114, 116, left long slope. Error propagation may be defined by:

$$c_{RF}=c_{RR}+L*LS-L*RS$$

$$\sigma_{RF}^2=\sigma_{RR}^2+L^2*\sigma_{LS}^2+L^2*\sigma_{RS}^2$$

Assuming both the left and right slope sensors 112, 114, 116 have similar standard errors, the variance equation reduces to:

$$\sigma_{RF}^2=\sigma_{RR}^2+2*(L^2\sigma_{LS}^2)$$

Substituting in the previous example parameters (L is 15', standard error is 0.05%:

$$\sigma_{RF}=0.013'$$

Moving slope sensors 112, 114, 116 toward the end-car on the mule mounts, the processor 100 may average the left and right long slope, thus reducing the error of the mean (from 0.05% to 0.035%). Depending on the flex of the machine, the width, and the placement, error could be reduced to:

$$\sigma_{RF}=0.011'$$

In another embodiment of the present invention, the processor 100 performs a self-leveling process using the left or right front leg as the grade leg. Then the slope is used to control the remaining three legs. Grade equations similar to those above are shown, however in this example the right rear leg RR has the largest error:

$$c_{LF}=D_{LF}-d_{LF}$$

$$c_{LF}=D_{LF}-L*(D_1-LS)$$

$$c_{RF}=D_{LF}+W*(D_{CS}-CS)$$

$$c_{LF}=D_{LF}-L*(D_1-LS)$$

This embodiment is suited for 3D mixed mode, where a 3D system steers the machine and controls absolute grade on one front corner. Significant improvement in single sensor 112, 114, 116 steering is achieved with a forward mounted sensor 112, 114, 116. This embodiment is highly effective for a rock hopper mold that has a more forward exit point than an extruding pan. Also with generous slope support averaging several slope sensors 112, 114, 116, this embodiment may be used on mainline concrete pavers and zero clearance mold pavers where the cross-slope and long slope values provide desired values for zero clearance mold support.

Figure 2:
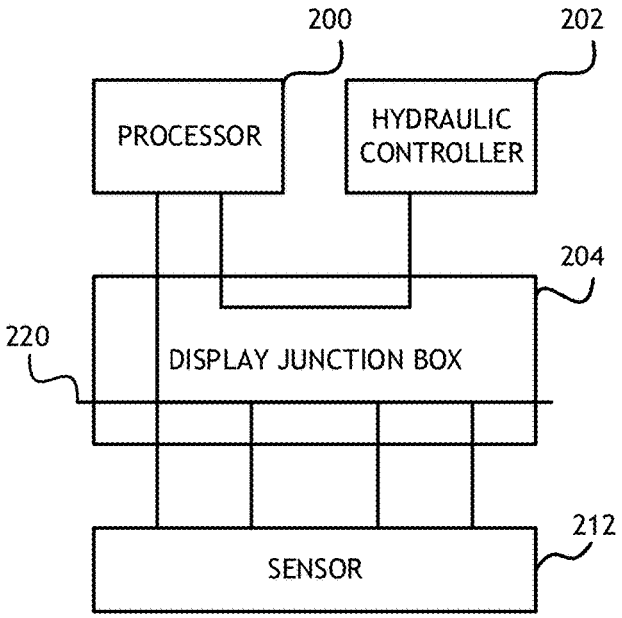
FIG. 2 shows a block diagram of one embodiment of the present invention.

Referring to FIG. 2, a block diagram of one embodiment of the present invention is shown. A system according to at least one embodiment of the present invention may include a display junction box (DJB) 204 and a processor 200 connected to the DJB 204 and to an actuator control 202 such as a hydraulic controller. The processor 200 may connect to a sensor 212 controller area network while the actuator controller 202 may be connected to a separate machine controller area network. Such system may include ski sensors 212 and a slope sensor 212, with analog steering. The ends of the trunk 220 may have elements to terminate the controller area network associated with the sensors 212. The DJB 204 may be interposed between a display, the sensors 212, and actuator controller 202.

A first, machine controller area network may connect the processor 200 to the actuator controller 202 while a second, sensor controller area network may connect the processor 200 to the sensors 212. In one embodiment, the two controller area networks may share a common cable, further including a display element. In a basic configuration, the total number of sensors 212 may be limited to the number of bulkhead connectors available on the DJB 204 with a maximum of nine of any single type of sensor 212.

Figure 3:
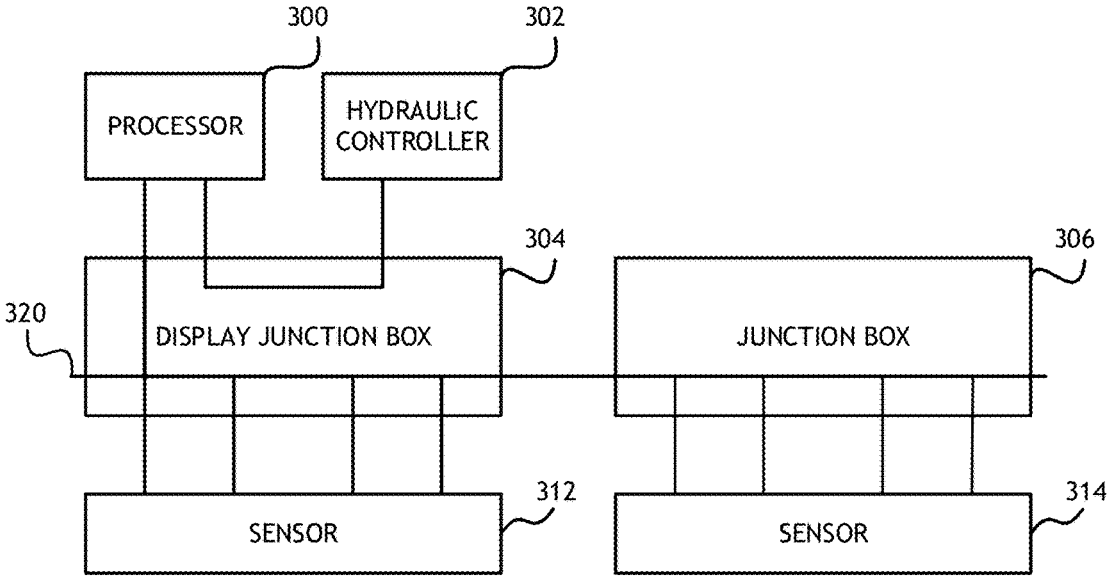
FIG. 3 shows a block diagram of another embodiment of the present invention.

Referring to FIG. 3, a block diagram of another embodiment of the present invention is shown. In one embodiment, a system may have a first set of sensors 312 attached to one side of a machine and a second set of sensors 314 attached to another side of a machine. To conform to controller area network specifications, the sensor controller area network bus trunk 320 may connect the first set of sensors 312 connected to a DJB 304 to the second set of sensors 314 connected to a second junction box 306. The sensor controller area network is still restricted to up to nine sensors 312, 314 of a single type. The total number of sensors 312, 314 can equal the number of node drops from the DJB 304 and second junction box 306.

The second junction box 306 is connected to the DJB 304 by the sensor controller area network trunk 320. Additional sensors can be added with additional junction boxes 306 connected to the sensor controller area network trunk 320 with the upper practical limit being seven junction boxes 306.

Figure 4:
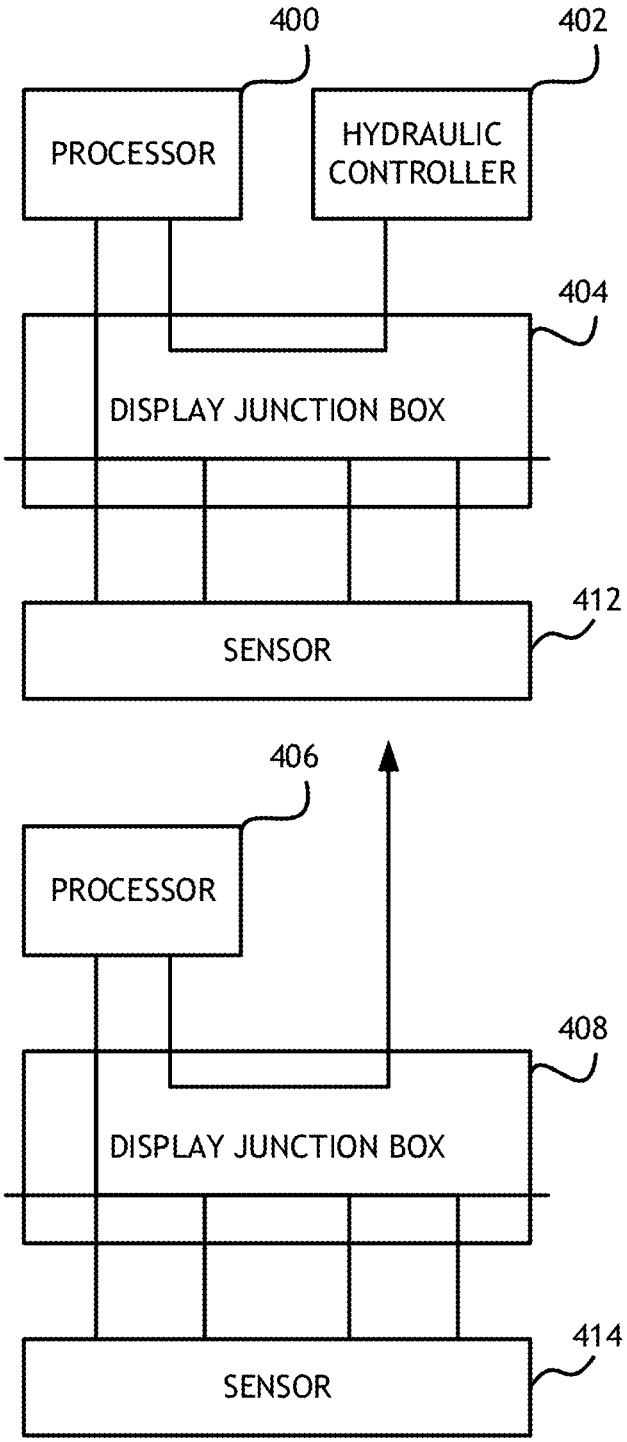
FIG. 4 shows a block diagram of another embodiment of the present invention.

Referring to FIG. 4, a block diagram of another embodiment of the present invention is shown. Where a system includes a DJB 404, a processor 400 connected to the DJB 404, an actuator control 402 connected to the processor 400 and sensors 412 connected to the processor 412, it may be desirable to have more than nine sensors 412, 414. For networks that require more than nine unique IDs for a single sensor 412, 414 type, sensors 412, 414 may be programmed with alternate ID's. Alternatively, and preferably, additional sensors 414 may be organized into sub-networks. A sub-network may include a second processor 406 connected to a second set of sensors 414 through a second DJB 408. A system according to this embodiment may mix virtual and real sensors 412, 414. Output for the first set of sensors 412 may be passed through the output of a sub-network relay. It is thereby possible to build a large network with several sub-networks branching off one another.

Where a total station is used, the leg nearest the prism is the grade leg, with slope controlling the remainder. Constant long and cross-slope is unlikely on many projects, therefore a two-way relay is envisioned.

Figure 5:
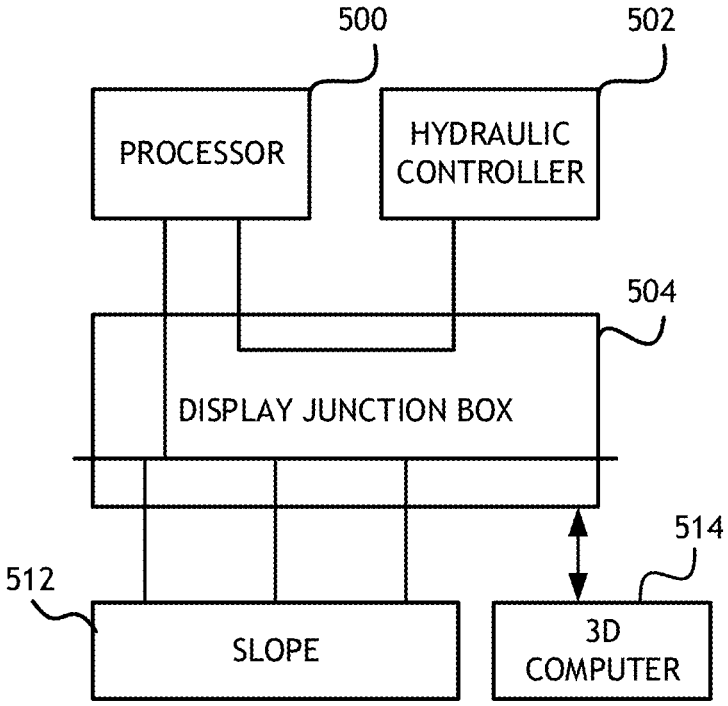
FIG. 5 shows a block diagram of another embodiment of the present invention.

Referring to FIG. 5, a block diagram of another embodiment of the present invention is shown. Where a system includes a DJB 404, a processor 400 connected to the DJB 404, an actuator control 402 connected to the processor 400 and sensors 412 connected to the processor 412, it may be desirable to have a two-way relay connecting the processor 500 to a 3D computer 514. The two-way relay has the additional feature of back-feeding average cross and long slope values onto the sensor controller area network and into slope sensor 512 messages.

By back-feeding improved slope data, the 3D computer 514 will accept them as measured values and compare them to the designed values from a design profile. The output from the 3D computer 514 passes back through the controller area network, with additional damping, to the processor 500. Front steering may be 3D computer 514 controlled while the rear steering angle on a four track machine may be set straight.

A system according to this embodiment may produce a paver style prime mover that has accurate and responsive slope control, that lets the front tracks steer, and follows a preplanned model. The two-way relay features allow for 3D computers 514 to be augmented, without upgrading software or hardware.

Figure 6:
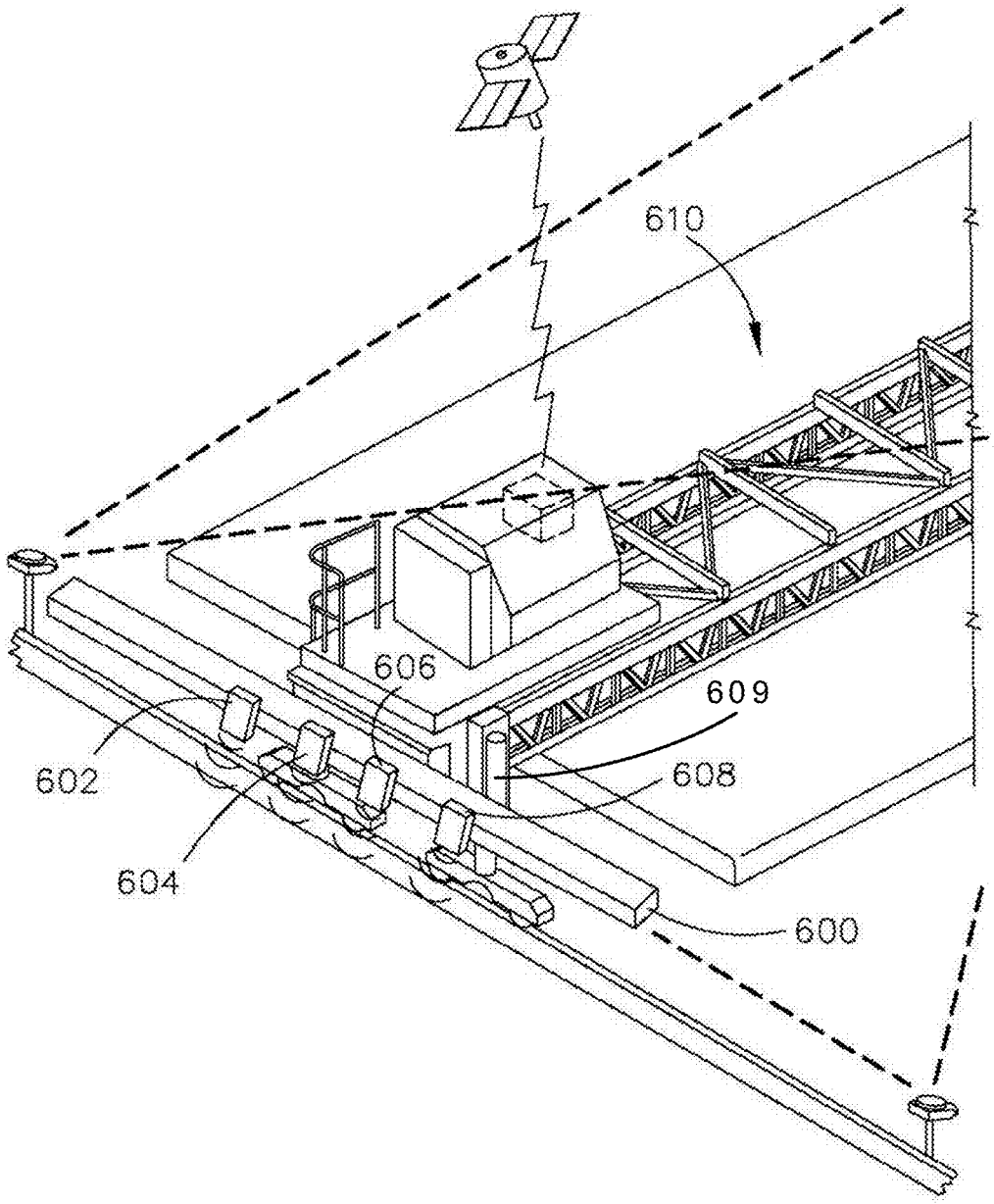
FIG. 6 shows a partial perspective environmental view of a paving machine according to one embodiment of the present invention.
Figure 7:
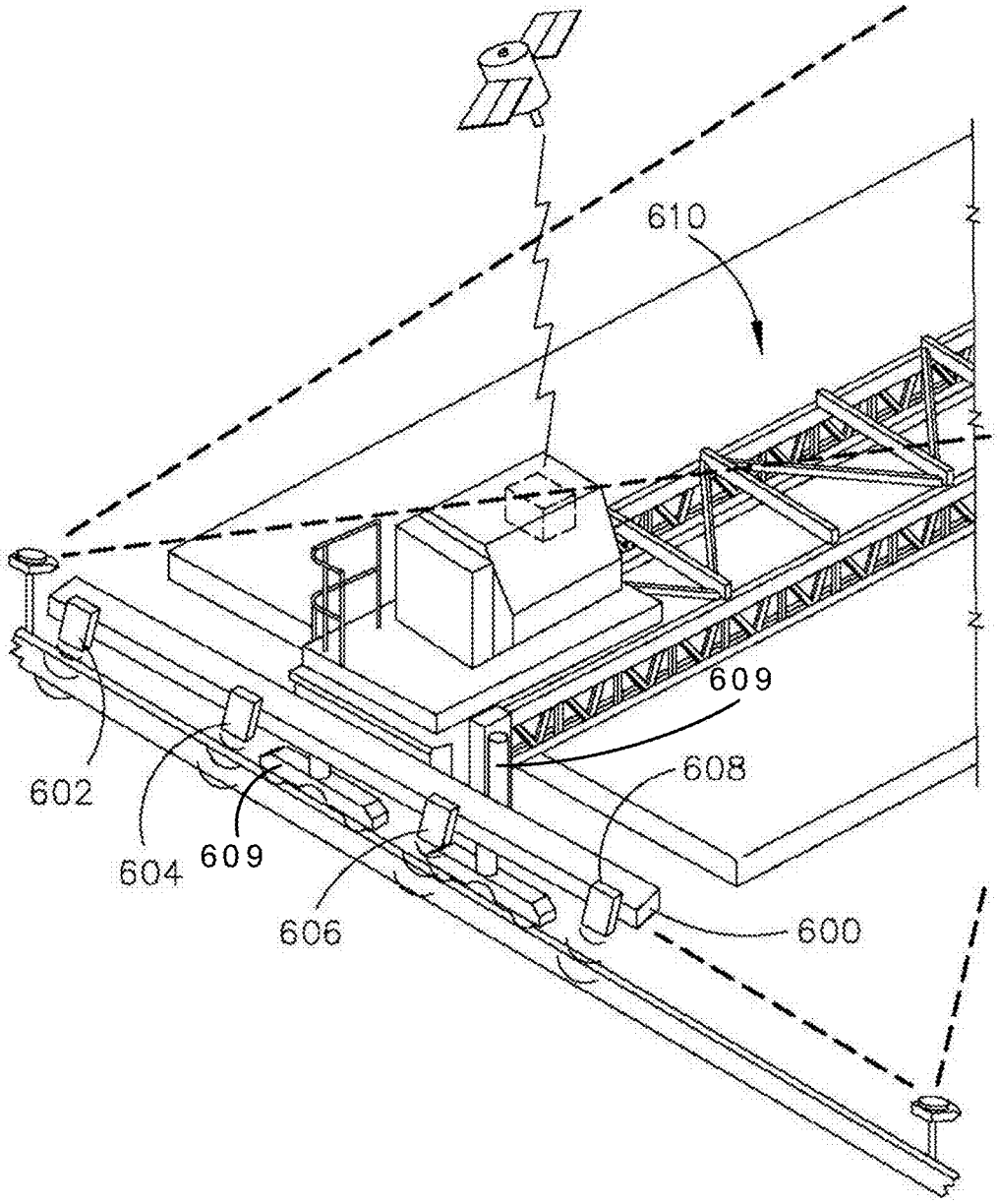
FIG. 7 shows a partial perspective environmental view of a paving machine according to one embodiment of the present invention.

Referring to FIGS. 6 and 7, partial perspective environmental views of a paving machine 600 according to embodiments of the present invention are shown. The machine 610 including a sensor mounting system 600 may have sensors 602, 604, 606, 608 in two separate configurations. A first configuration shown in FIG. 6 has the center two sensors 604, 606 shared between front and rear leg grade outputs. In a second configuration, shown in FIG. 7, the center two sensors 604, 606 are not shared. The ability to assign a second weighted output from sensors 602, 604, 606, 608 decreases the total number of sensors 602, 604, 606, 608 by sharing the sensor 602, 604, 606, 608 between two outputs. Sensor sharing may be combined with a sensor 602, 604, 606, 608 weighting feature. Unequal weighting may be desirable if the center sensors 604, 606 are more representative of the deviation/correction at the adjustable height drive leg 609. For rear sensors 602 ($s_1$) and 604 ($s_2$), deviation of the rear adjustable height drive leg 609 in a single assignment system may be defined by:

$$d_r = \tfrac{1}{2} * (s_1 + s_2)$$

while for front sensors 606 ($s_3$) and 608 ($s_4$), deviation of the front adjustable height drive leg 609 in a single assignment system may be defined by:

$$d_f = \tfrac{1}{2} * (s_3 + s_4)$$

In a dual assignment system where center sensors 604 ($s_2$) and 606 ($s_3$) are shared, deviation of the rear adjustable height drive leg 609 may be defined by:

$$d_r = \tfrac{1}{3} * (s_1 + s_2 + s_3)$$

while deviation of the front adjustable height drive leg 609 may be defined by:

$$d_f = \tfrac{1}{3} * (s_2 + s_3 + s_4)$$

Determining the weights for each sensor 602, 604, 606, 608 will be a function of the position of the sensor 602, 604, 606, 608, its type, the reference surface that is being offset, the machine 610, and many other variables. The secondary output has no restrictions or link on its weight and therefore can be different than the first output. In one example, a weighted deviation for the rear adjustable height drive leg 609 may be defined by:

$$d_r = \frac{1}{(1+3+1)} * (1s_1 + 3s_2 + 1s_3)$$

$$d_r = \frac{1}{5} * (1s_1 + 3s_2 + 1s_3)$$

while a weighted deviation for the rear adjustable height drive leg 609 may be defined by:

$$d_f = \frac{1}{4} * (1s_2 + 2s_3 + 1s_4)$$

where the weight for the center sensors 604, 606 are different that their respective weights for the rear adjustable height drive leg 609 weighted average deviation.

A user may assign up to four sensors 602, 604, 606, 608 per output. Weights are internally fixed for all assigned sensors 602, 604, 606, 608. However by double assigning a sensor 602, 604, 606, 608 to an output its effective weight to the average is double. Error can be reduced and the machine 610 more accurately controlled by adding sensors 602, 604, 606, 608 via standard deviation of means as described above. Spatial distribution of sensors 602, 604, 606, 608 on the machine, i.e. evenly spread out, will ensure that the values are more independent and helpful in reducing the error.

Figure 8:
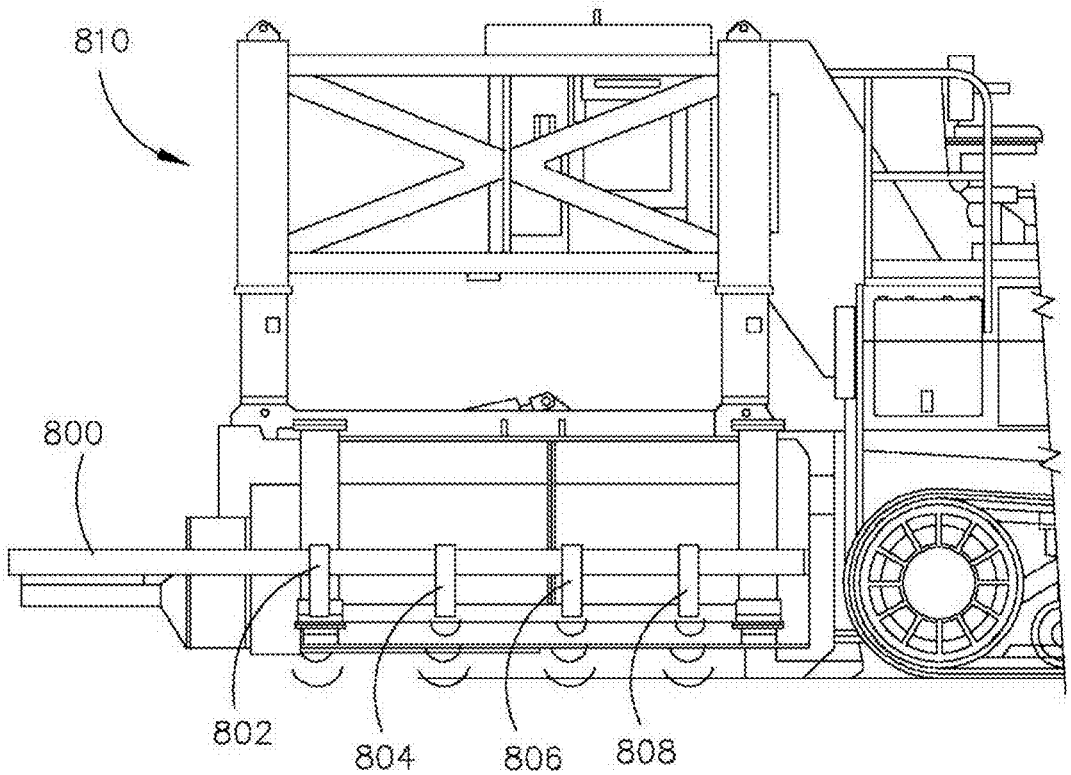
FIG. 8 shows a partial side view of a paver extruding surface including one embodiment of the present invention.
Figure 9:
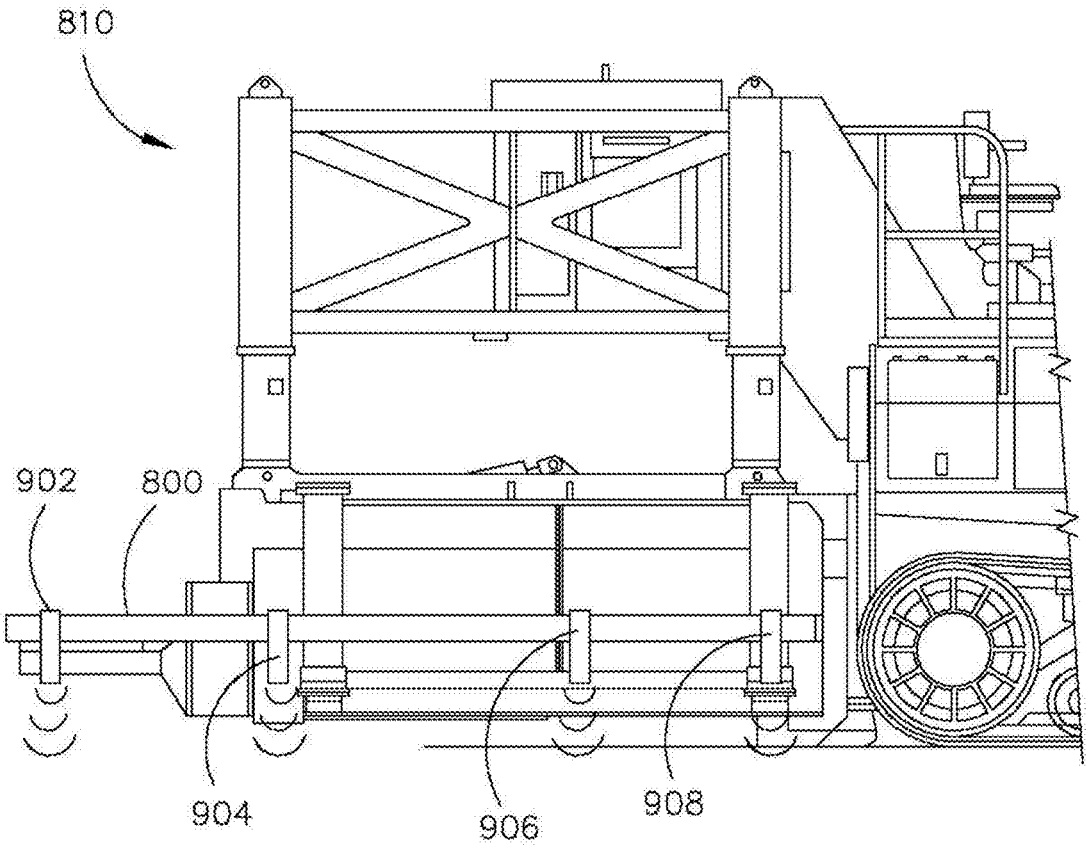
FIG. 9 shows a partial side view of a paver extruding surface including one embodiment of the present invention.

Referring to FIGS. 8 and 9, partial side views of a paver extruding surface including embodiment of the present invention are shown. A paving machine 810 according to embodiments of the present invention may include a sensor mounting system 800 such as a platform that allows adjustable positioning of a plurality of sensors 802, 804, 806, 808 in a first configuration for measuring slope changes over a short distance by being closely spaced. Alternatively, the plurality of sensors 902, 904, 906, 908 may be in a second configuration for measuring slope changes more precisely over a long distance.

In another embodiment of the present invention, sensors 802, 804, 806, 808, 902, 904, 906, 908 may be mounted on opposing sides a a paving machine 810 to measure cross-slope in addition to slope.

Figure 10:
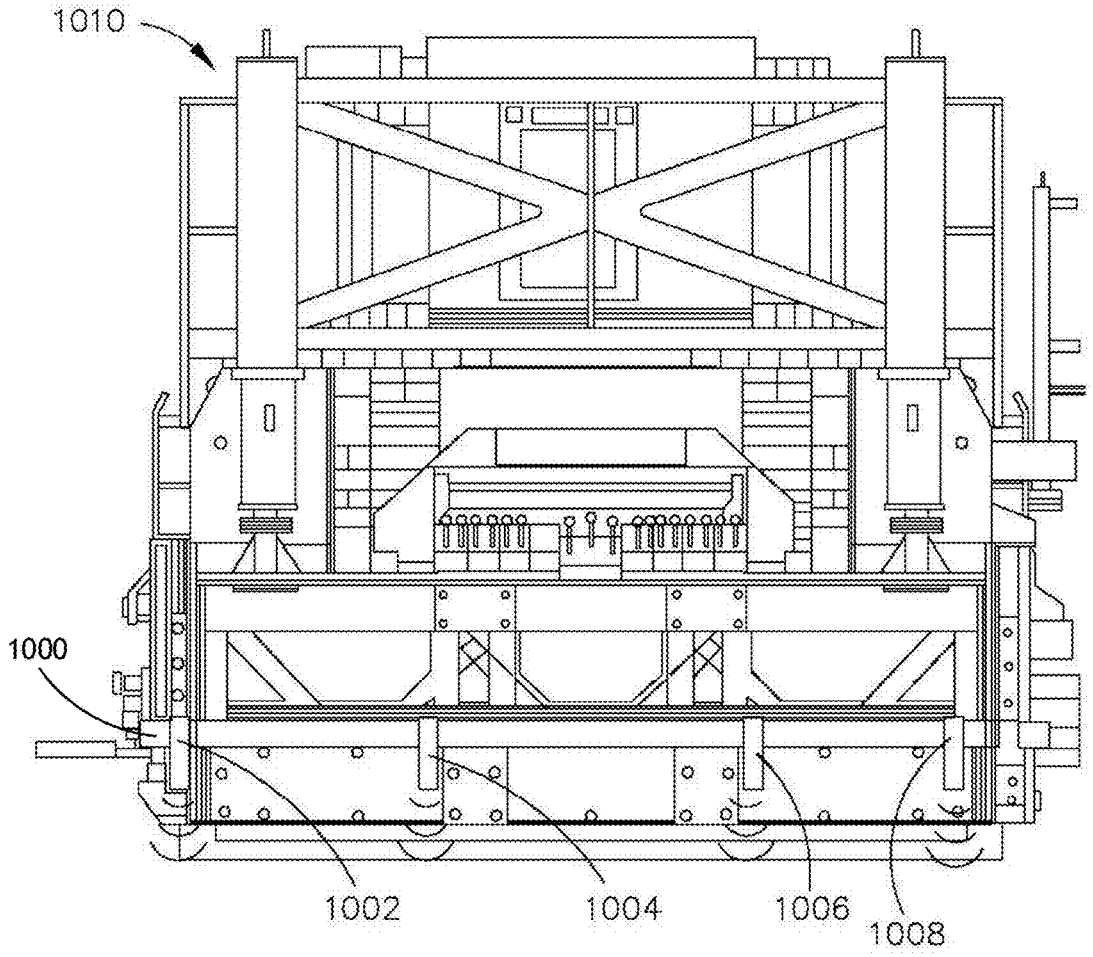
FIG. 10 shows a rear view of a paver extruding surface including one embodiment of the present invention.

Referring to FIG. 10, a rear view of a paver extruding surface including one embodiment of the present invention is shown. A paving machine 1010 according to embodiments of the present invention may include a sensor mounting system 1000 such as a platform that allows adjustable positioning of a plurality of sensors 1002, 1004, 1006, 1008 in a configuration for measuring cross-slope.

Figure 11:
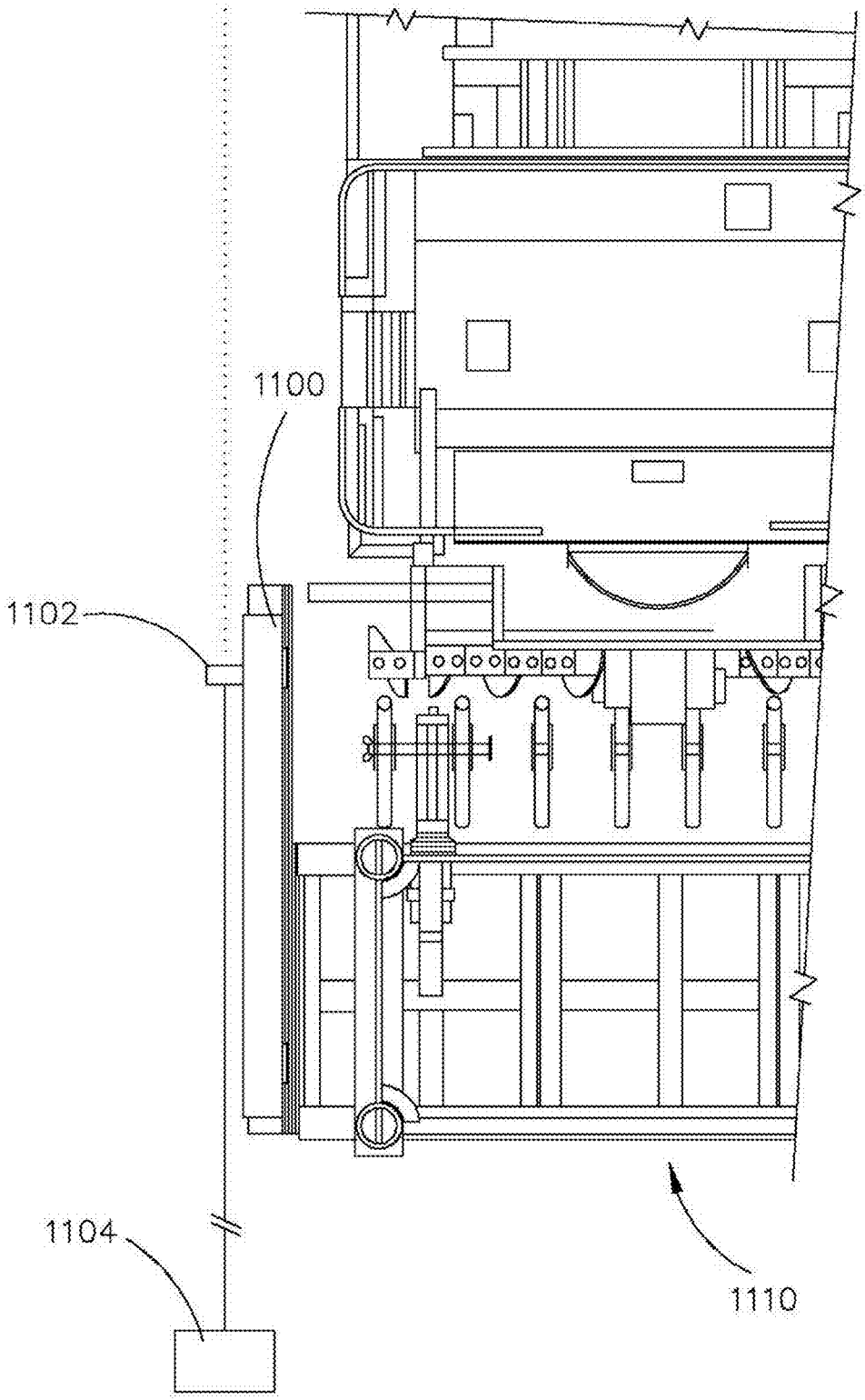
FIG. 11 shows a partial top view of a paver extruding surface according to one embodiment of the present invention.

Referring to FIG. 11, a partial top view of a paver extruding surface according to one embodiment of the present invention is shown. A machine 1110 including embodiments of the present invention may be configured to steer a straight horizontal line. A rotating laser transmitter 1104 produces a vertical plane. A specially adapted tripod may tilt the rotating laser transmitter 1104 to produce a vertical laser plane. One or more receivers 1102 mounted horizontally to the machine 1110. In one embodiment, the one or more receivers 1102 may be mounted to an adjustable mounting system 1100. Receivers 1102 may be mounted at different heights such that receivers 1102 do not obstruct each other's line of the sight to the vertical laser plane.

Steering with a laser system is low cost method for straight runs. For grade applications a laser is subject to gravitational curvature and refraction. In a vertical configuration these two systematic errors are eliminated. The result is a laser steer system that can have significantly further range than a grade system.

Obstructions can be minimized by elevating the receivers 1102 and transmitter 1104. Grade can likewise be laser controlled with offsets between grade and steer receivers 1102 required to eliminate interference.

In another embodiment, a computer system is configured to control the grade in the rear of a machine including dual laser receivers 1102 mounted above the rear of the extruding pan of a paver. Left and right grade matching in the rear only would also be an application of this method. Grade deviation equations for this method may be defined by:

$$c_{RF}=D_{RR}-d_{RR}$$

$$c_{LF}=D_{LR}-d_{LR}$$

The front legs (if used) are slope controlled relative to their respective rear legs:

$$c_{RF}=c_{RR}-L^*(D_1-RS)$$

$$c_{LF}=c_{LR}-L^*(D_1-LS)$$

Depending on the equipment and hydraulic controller configuration, some standard output corrections may be ignored.

In another embodiment of the present invention, dual laser receivers 1102 are mounted above a trimmer's cutting edge. Left and right grade matching for a trimmer or rock hopper are also envisioned. Grade deviation equations for this method may be defined by:

$$c_{RF}=D_{RF}-d_{RF}$$

$$c_{LF}=D_{LF}-d_{LF}$$

The rear legs (if used) are slope control and relative to their respective front legs.

$$c_{RR}=c_{RF}-L^*(D_1-RS)$$

$$c_{LR}=c_{LF}-L^*(D_1-LS)$$

Embodiments may always output six corrections even if the specific machine will only use a subset. A system according to this embodiment may control a motor grader, dozer or other construction equipment with a blade.

Additional methods and embodiments are envisioned using three grade legs and slope matching to control the remaining leg.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A paving machine comprising:

a plurality of adjustable height drive legs;

a plurality of sensors affixed to known locations on the paving machine; and a control computer connected to each of the plurality of sensors, wherein the control computer is configured to:

receive data from each of the plurality of sensors, the data corresponding to a distance of the sensor from a reference surface;

receive a set point defining a desired location and orientation of the paving machine;

determine an actual location and orientation of the paving machine based on the data from the plurality of sensors;

define one of the adjustable height drive legs as a controlling leg;

determine a weighted deviation for each of the plurality of adjustable height drive legs based on the data from the plurality of sensors weighted according to a position of each sensor and a type of each sensor, the weighted deviation corresponding to an extension adjustment to make the actual location and orientation substantially conform to the desired location and orientation by determining a grade deviation associated with the controlling leg, determining a deviation for a first neighboring adjustable height drive leg relative to the controlling leg with reference to a width of the paving machine, determining a deviation for a second neighboring adjustable height drive leg relative to the controlling leg with reference to a length of the paving machine, and determining a deviation for a third neighboring adjustable height drive leg relative to the controlling leg with reference to both the length and the height of the paving machine; and actuate each of the plurality of adjustable height drive legs to apply each determined weighted deviation.

2. The paving machine of claim 1, wherein the control computer is further configured to identify one of the plurality of adjustable height drive legs as a reference leg, the weighted deviation associated with each of the other adjustable height drive legs being determined with reference to the reference leg.

3. The paving machine of claim 1, wherein the weighted deviation associated with each adjustable height drive leg define a grade or slope value for the paving machine.

4. The paving machine of claim 1, wherein the weighted deviation associated with each adjustable height drive leg define a cross-slope value for the paving machine.

5. The paving machine of claim 1, wherein:

the weighted deviation of a first adjustable height drive leg is based on data from a first sensor in the plurality of sensors and a second sensor in the plurality of sensors; and the weighted deviation of a second adjustable height drive leg is based on data from a third sensor in the plurality of sensors and a fourth sensor in the plurality of sensors.

6. The paving machine of claim 5, wherein:

the weighted deviation of the first adjustable height drive leg is further based on data from the third sensor in the plurality of sensors; and the weighted deviation of the second adjustable height drive leg is further based on data from the second sensor in the plurality of sensors.

7. The paving machine of claim 1, wherein at least one of the sensors comprises a laser receiver.

8. A computer apparatus comprising:

a processor;

a plurality of sensors connected to the processor, each sensor associated with a known location on a paving machine; and computer executable program code configured to instruct the processor to:

receive data from each of the plurality of sensors, the data corresponding to a distance of the sensor from a reference surface;

receive a set point defining a desired location and orientation of the paving machine;

determine an actual location and orientation of the paving machine based on the data from the plurality of sensors;

define one of the adjustable height drive legs as a controlling leg;

determine a weighted deviation for each of a plurality of adjustable height drive legs based on the data from the plurality of sensors weighted according to a position of each sensor and a type of each sensor, the weighted deviation corresponding to an extension adjustment to make the actual location and orientation substantially conform to the desired location and orientation by determining a grade deviation associated with the controlling leg, determining a deviation for a first neighboring adjustable height drive leg relative to the controlling leg with reference to a width of the paving machine, determining a deviation for a second neighboring adjustable height drive leg relative to the controlling leg with reference to a length of the paving machine, and determining a deviation for a third neighboring adjustable height drive leg relative to the controlling leg with reference to both the length and the height of the paving machine; and actuate each of the plurality of adjustable height drive legs to apply each determined weighted deviation.

9. The computer apparatus of claim 8, wherein the computer executable program code further configures the processor to identify one of the plurality of adjustable height drive legs as a reference leg, the weighted deviation associated with each of the other adjustable height drive legs being determined with reference to the reference leg.

10. The computer apparatus of claim 8, wherein the weighted deviation associated with each adjustable height drive leg define a grade or slope value for the paving machine.

11. The computer apparatus of claim 8, wherein the weighted deviation associated with each adjustable height drive leg define a cross-slope value for the paving machine.

12. The computer apparatus of claim 8, wherein:

the weighted deviation of a first adjustable height drive leg is based on data from a first sensor in the plurality of sensors and a second sensor in the plurality of sensors; and the weighted deviation of a second adjustable height drive leg is based on data from a third sensor in the plurality of sensors and a fourth sensor in the plurality of sensors.

13. The computer apparatus of claim 12, wherein:

the weighted deviation of the first adjustable height drive leg is further based on data from the third sensor in the plurality of sensors; and the weighted deviation of the second adjustable height drive leg is further based on data from the second sensor in the plurality of sensors.

14. The computer apparatus of claim 8, wherein at least one of the sensors comprises a laser receiver.

15. A construction machine control network comprising:

a sensor controller area network connected to a plurality of sensors;

a machine controller area network connected to a plurality of actuators for controlling the position and orientation of a construction machine;

a processor connected to the sensor controller area network and the machine controller area network; and computer executable program code configured to instruct the processor to:

receive messages from each of the plurality of sensors, the messages corresponding to a distance of the sensor from a reference surface;

receive a set point defining a desired location and orientation of the construction machine;

determine an actual location and orientation of the construction machine based on the messages from the plurality of sensors;

define one of the adjustable height drive legs as a controlling leg;

determine a weighted deviation for each of the plurality of actuators based on the messages from the plurality of sensors weighted according to a position of each sensor and a type of each sensor, the weighted deviation corresponding to an extension adjustment to make the actual location and orientation substantially conform to the desired location and orientation by determining a grade deviation associated with the controlling leg, determining a deviation for a first neighboring adjustable height drive leg relative to the controlling leg with reference to a width of the paving machine, determining a deviation for a second neighboring adjustable height drive leg relative to the controlling leg with reference to a length of the paving machine, and determining a deviation for a third neighboring adjustable height drive leg relative to the controlling leg with reference to both the length and the height of the paving machine; and send one or more messages to the machine controller area network to actuate each of the plurality of actuators, the one or more messages corresponding to the determined weighted deviation.

16. The construction machine control network of claim 15, further comprising a sensor controller automated sub-network connected to the sensor controller area network, the sensor controller automated sub-network connected to a second plurality of sensors.

17. The construction machine control network of claim 15, further comprising a junction box connected to the sensor controller area network, the junction box connected to a second plurality of sensors.

18. The construction machine control network of claim 15, wherein:

the weighted deviation of a first actuator is based on data from a first sensor in the plurality of sensors and a second sensor in the plurality of sensors; and the weighted deviation of a second actuator is based on data from a third sensor in the plurality of sensors and a fourth sensor in the plurality of sensors.

19. The construction machine control network of claim 18, wherein:

the weighted deviation of the first actuator is further based on data from the third sensor in the plurality of sensors; and the weighted deviation of the second actuator is further based on data from the second sensor in the plurality of sensors.

20. The construction machine control network of claim 15, wherein at least one of the sensors comprises a laser receiver.

* * * * *